US011089856B2

(12) United States Patent
Mor

(10) Patent No.: US 11,089,856 B2
(45) Date of Patent: Aug. 17, 2021

(54) HAIR STRAIGHTENING APPARATUS

(71) Applicant: Nissim Mor, Kiryat Ono (IL)

(72) Inventor: Nissim Mor, Kiryat Ono (IL)

( * ) Notice: Subject to any disclaimer, the term of this patent is extended or adjusted under 35 U.S.C. 154(b) by 350 days.

(21) Appl. No.: 16/072,506

(22) PCT Filed: Jan. 24, 2017

(86) PCT No.: PCT/IL2017/050091
§ 371 (c)(1),
(2) Date: Jul. 26, 2018

(87) PCT Pub. No.: WO2017/130192
PCT Pub. Date: Aug. 3, 2017

(65) Prior Publication Data

US 2020/0085160 A1 Mar. 19, 2020

(30) Foreign Application Priority Data

Jan. 28, 2016 (IL) ..... 243841

(51) Int. Cl.
*A45D 1/04* (2006.01)
*A45D 2/00* (2006.01)

(52) U.S. Cl.
CPC ..... *A45D 1/04* (2013.01); *A45D 2/001* (2013.01)

(58) Field of Classification Search
CPC ..... A45D 7/02; A45D 7/06
USPC ..... 132/224, 269; 219/225
See application file for complete search history.

(56) References Cited

U.S. PATENT DOCUMENTS 2,150,285 A * 3/1939 Bela Marek ..... A45D 1/04 219/225
2005/0155620 A1* 7/2005 Gold ..... B29C 66/861 132/271
2010/0101598 A1* 4/2010 Ng ..... A45D 2/001 132/223
2011/0056509 A1* 3/2011 Benest ..... F25B 21/02 132/223

(Continued)

FOREIGN PATENT DOCUMENTS

JP 2005087629 4/2005
JP 2005087629 A * 4/2005

(Continued)

*Primary Examiner* — Jacqueline T Johanas
*Assistant Examiner* — Thomas Drew Agger
(74) *Attorney, Agent, or Firm* — AlphaPatent Associates, Ltd; Daniel J. Swirsky

(57) ABSTRACT

In one aspect, the present invention is directed to a hair straightening apparatus, comprising: two jaws (12), pivotally connected by a hinge (14); two ironing plates (16), each installed in a different jaw of the jaws, and a heating mechanism of the ironing plates; the jaws having an open state in which the ironing plates are drawn from each other, and a close state in which the ironing plates attach each other; a group of electromagnets (26) installed on one of the jaws, and a corresponding magnetic object installed in the other jaw, wherein the corresponding magnetic object is in a form of a ferromagnetic plate (38) or in a form of another group of electromagnets; an on/off button (24), for activating/deactivating electric power supply to the electromagnets, wherein the power supply is sufficient turning the jaws from the open state to the close state.

12 Claims, 7 Drawing Sheets

(56) References Cited

U.S. PATENT DOCUMENTS

| | | | | |
|---|---|---|---|---|
| 2012/0024311 | A1* | 2/2012 | Linglin | A45D 2/002<br>132/232 |
| 2012/0312319 | A1* | 12/2012 | Uwano | A45D 2/001<br>132/211 |
| 2014/0137887 | A1* | 5/2014 | Cocks | A45D 2/001<br>132/224 |

FOREIGN PATENT DOCUMENTS

| | | | |
|---|---|---|---|
| KR | 20030039865 | A * | 5/2003 |
| KR | 20120095207 | | 8/2012 |

* cited by examiner

HAIR STRAIGHTENING APPARATUS

TECHNICAL FIELD

The present invention relates to the field of hair straightening devices.

BACKGROUND ART

FIG. 1 schematically illustrates a hair straightening apparatus, according to the prior art.

The hair straightening apparatus is marked herein by reference numeral 10. It comprises two "jaws" 12, pivotally connected by axle 14 at one end thereof. The angle between the jaws is limited to about 20 degrees.

The hair straightening apparatus also comprises a spring (not shown) which draws the jaws away from each other, i.e., turns the angle between the jaws to the maximum limit.

Each of the jaws comprises an ironing plate 16 that turns towards the ironing plate of the other jaw. The ironing plates are usually made of ceramic material or coated with titanium. During a hair straightening operation the ceramic plates are heated.

As such, the jaws of the hair straightening apparatus have two states: a "closed state", in which the ironing plates touch each other, and an "open state" in which the ironing plates are drawn away from each other. In FIG. 1 the jaws of the apparatus are in the open state. The open state of the apparatus is the idle state.

Each of FIGS. 2 and 3 schematically illustrates the apparatus of FIG. 1, while being used.

In FIG. 2 the jaws of the apparatus are in the open state, while in FIG. 3 they are is in the closed state. The dashed arrow of FIG. 3 illustrates the power the user's thumb applies on the upper jaw.

Upon pressing one of the operational buttons 18 which dedicated for turning on the heating of the ceramic plates, the ceramic plates are electrically heated to a temperature of between 180 to 230 degrees, according to a setup thereof. In this situation, the user places a strand of hair between the jaws (not illustrated), presses with his thumb 22 on the upper jaw towards the lower jaw, and pulls the apparatus along the strand of hair. Then the user releases his pressure on the jaw in order to allow the apparatus to turn to its open state, and repeats this operation. Actually, this operation is ironing the strand of hair.

Each ironing cycle straightens the strands slightly, and in order to bring the hair to a desired straightness, the user must repeat the ironing cycle several times.

Straightening long hair takes between about 30 to 60 minutes. All this time the thumb intermittently presses the upper jaw towards the lower jaw for (a) overcoming the spring's power, and (b) pressing the jaws against each other in order to iron the hair.

A hairdresser that performs this operation several hours each day may damage his hand, and specially the hand tendons. Sometimes such an injury is severe, and it may require a treatment of weeks during which the hairdresser cannot work.

All the methods described above have not yet provided satisfactory solutions to the problem of the damage caused due to intensive use of a hair straightening apparatus.

It is an object of the present invention to provide a solution to the above-mentioned and other problems of the prior art.

It is another object of the present invention to provide a hair straightening apparatus in which the pressure applied by a user on the jaws is negligible, and as such, prevents physical damage to the user.

It is yet another object of the present invention to provide a hair straightening apparatus in which the force the jaws apply on each other is constant.

Other objects and advantages of the invention will become apparent as the description proceeds.

SUMMARY OF THE INVENTION

In one aspect, the present invention is directed to a hair straightening apparatus, comprising:

- two jaws (12), pivotally connected by a hinge (14);
- two ironing plates (16), each installed in a different jaw of the jaws, and a heating mechanism of the ironing plates;
- the jaws having an open state in which the ironing plates are drawn from each other, and a closed state in which the ironing plates attach each other;
- a group of electromagnets (26) installed on one of the jaws, and a corresponding magnetic object installed in the other jaw, wherein the corresponding magnetic object is in a form of a ferromagnetic plate (38) or in a form of another group of electromagnets; and
- an on/off button (24), for activating/deactivating the electric power supply to the electromagnets, wherein the power supply is sufficient for turning the jaws from the open state to the closed state.

An "on/off button" is also known in the art as "switch".

The hair straightening apparatus comprises a spring for retaining the jaws in the open state. Alternatively, the apparatus is adapted to push the jaws away from each other in the open state, by switching the power direction.

The on/off button may be in a form of an elastic dome having two contacts that touch each other upon pressing on the dome, a touch button, and so on.

According to one embodiment of the invention, the apparatus comprises a controller, for changing the intensity of the power supply to the electromagnets according to a program embedded therein. The controller may be in a form of an integrated circuit ("chip"), an electric circuit, an electronic circuit, and so on.

According to one embodiment of the invention, the controller is adapted to soften an approaching process of the jaws to each other, e.g., by increasing the electric power intensity gradually.

According to one embodiment of the invention, the controller is adapted to apply constant power while the jaws are in the close state. The constant intensity can be set by input means, such as a slider, knob, etc.

According to one embodiment of the invention, the controller is adapted to apply cycles of:

- a first period in which the jaws are in the closed state; and
- a second period in which the jaws are in an open state; thereby allowing a user to iron a strand of hair without lifting his thumb from the on/off button (24).

The hair straightening apparatus may further comprise an input device for inputting at least three values to the apparatus, for setting the heating temperature, setting the pulling power of the electromagnets, and the like. Such an input device may be, for example, a slider, a knob, and the like.

According to a basic design of the hair straightening apparatus, the electromagnets have identical magnetic characteristics.

According to a further design of the hair straightening apparatus, the electromagnets have different magnetic characteristics. For example, the pulling characteristic of the electromagnets near the axle have to be higher than the other electromagnets, since they start the pulling process, and they must overcome the spring's resistance.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF DRAWINGS

Preferred embodiments, features, aspects and advantages of the present invention are described herein in conjunction with the following drawings.

Each of FIGS. 2 and 3 schematically illustrates the apparatus of FIG. 1, while being used.

It should be understood that the drawings are not necessarily drawn to scale.

DESCRIPTION OF EMBODIMENTS

The present invention will be understood from the following detailed description of preferred embodiments ("best mode"), which are meant to be descriptive and not limiting. For the sake of brevity, some well-known features, methods, systems, procedures, components, circuits, and so on, are not described in detail.

Figure 1:
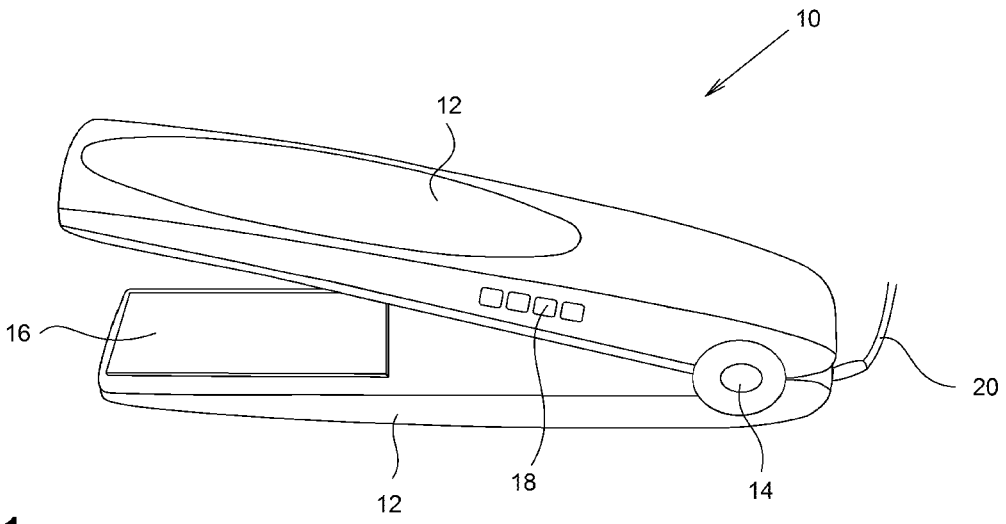
Fig. 1 PRIOR ART
FIG. 1 schematically illustrates a hair straightening apparatus, according to the prior art.
Figure 2:
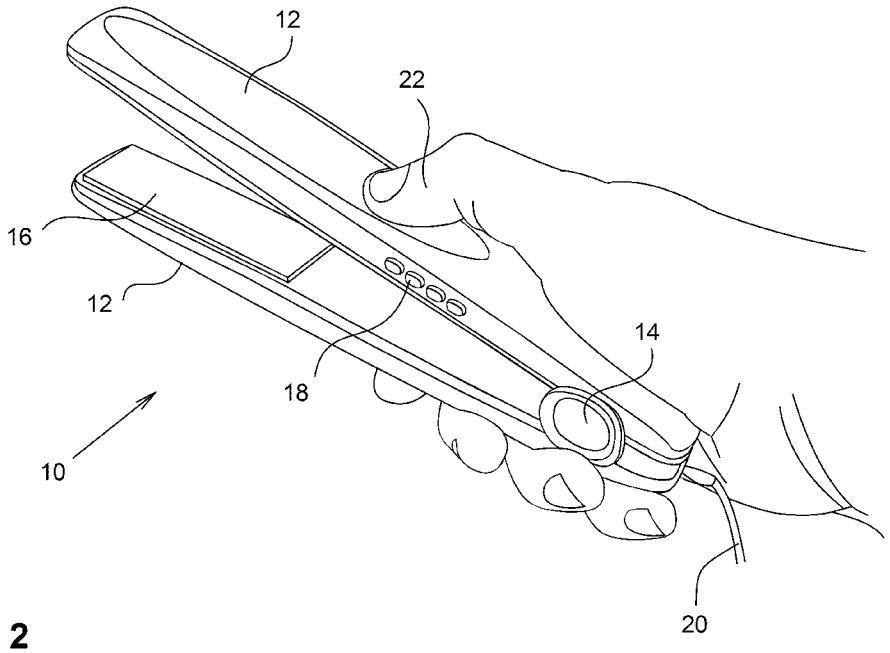
Fig. 2 PRIOR ART
In FIG. 2 the jaws of the apparatus are in the open state, while in FIG. 3 they are in the closed state.
Figure 3:
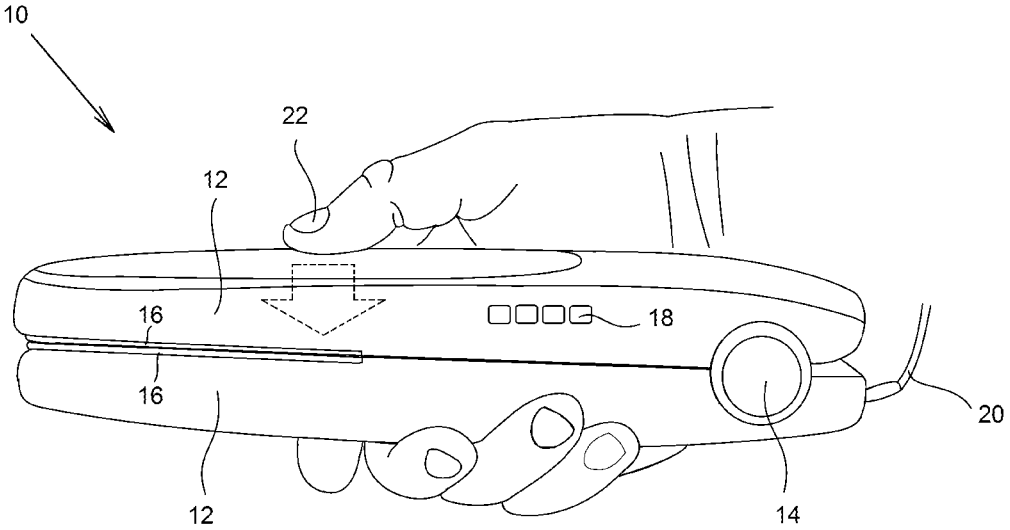
Fig. 3 PRIOR ART
Figure 4:
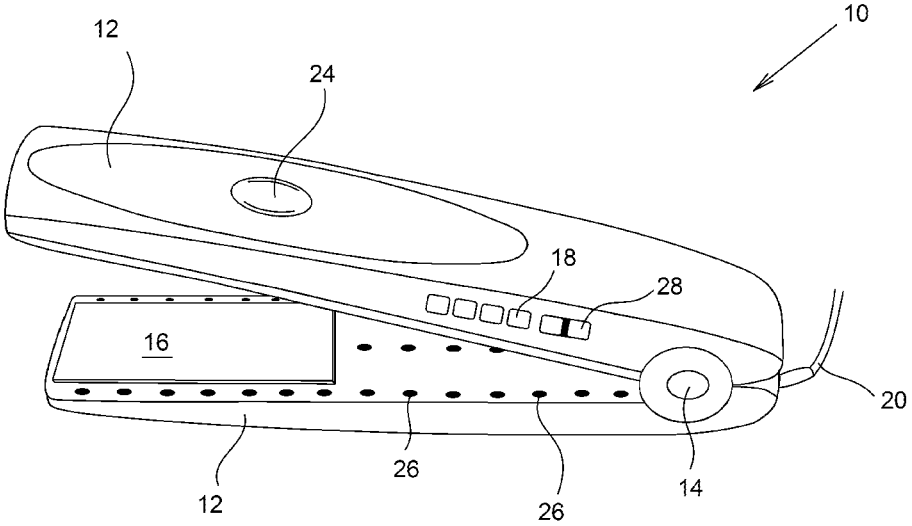
FIG. 4 schematically illustrates a hair straightening apparatus, according to one embodiment of the invention.

FIG. 4 schematically illustrates a hair straightening apparatus, according to one embodiment of the invention.

Figure 5:
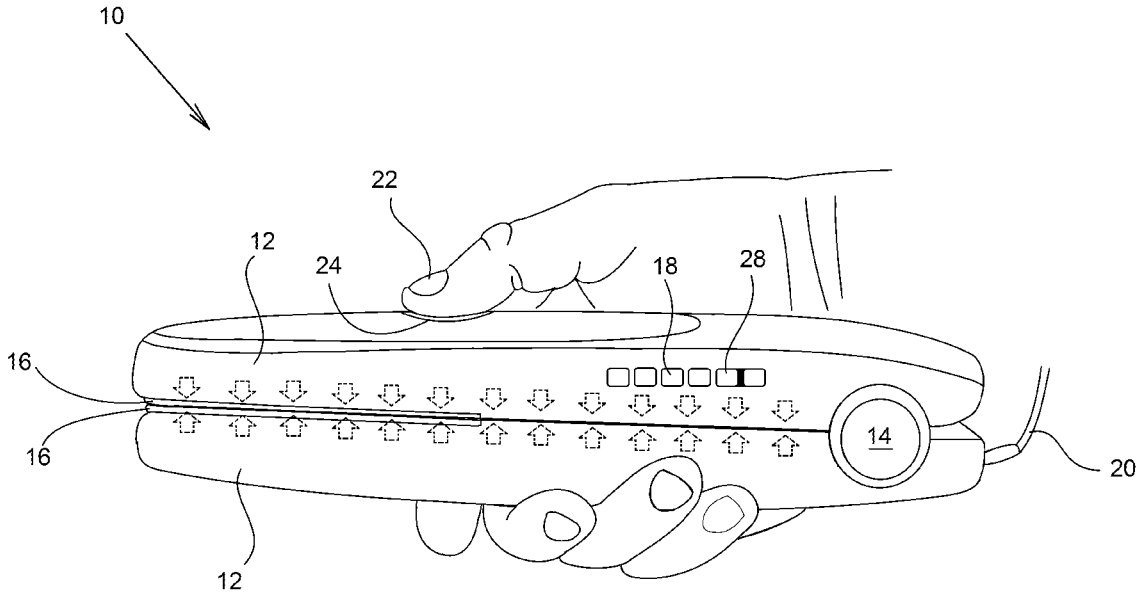
FIG. 5 schematically illustrates a use of a hair straightening apparatus, according to one embodiment of the invention.

FIG. 5 schematically illustrates a use of a hair straightening apparatus, according to one embodiment of the invention.

The difference between the hair straightening apparatus of the present invention and the hair straightening apparatus of the prior art is the mechanism that approaches the jaws to each other. While in the prior art the user has to use his own power to press the upper jaw towards the lower jaw, according to the present invention the jaws are pulled to each other as a result of turning on an on/off button 24.

As such, the power the user has to apply for the ironing is negligible in comparison to the prior art, and therefore does not harm the user's hand as in the prior art.

The mechanism that causes the jaws 12 to be pulled to each other is a group of electromagnets 26 installed on one jaw, while the other jaw comprises a corresponding ferromagnetic plate. Alternatively, the other jaw comprises corresponding electromagnets installed such that they have opposite polarity than the polarity of the electromagnets of the first jaw.

In FIG. 5 the dashed arrows present the pulling direction of the magnetic objects, i.e., the electromagnets and the ferromagnetic plate.

In FIG. 4 the electromagnets 26 are installed on the lower jaw of the apparatus, but alternatively they can be installed on the upper jaw.

A user can set the applied electromagnetic intensity by slider 28, a knob (not illustrated), and actually by any input means through which a user can define at least three values.

The electromagnets do not have to be revealed, but in designing such an apparatus the distance between the magnetic objects must be taken into consideration, since the power two magnetic objects pull/push each other decreases exponentially as the distance increases.

In FIG. 4 the electromagnets 26 are dispersed along the entire jaw, i.e., at the near edge to the axle 14 of the jaw, as well as at the far edge of the jaw from the axle.

The reason for this arrangement is the exponential decreasing of the magnetic power as the distance between the magnetically attracted objects increases. Thus, assuming the electromagnets are identical, and the same electric power is applied on them, the pulling power of the "near" electromagnets to the axle 14 should be greater than the pulling power of the "far" electromagnets from the axle.

Thus, in the open state, when applying electric power to the electromagnets, the electromagnets that mostly influence at the beginning are those near the axle, as the distance between them is the shorter. As the jaws approach to each other, additional electromagnets enter into influence. As such, the approaching process of the jaws to each other is gradual.

According to a further embodiment of the invention, the apparatus applies a controller for changing the pulling power of the electromagnets during the process of approaching the jaws to each other in order to soften the approach. After the jaws reach their closed state, the controller applies a constant pulling power suitable for the hair ironing. Of course, these functions can be set by input means such as a slider.

Additional means that can be used for obtaining a controlled operation is electromagnets of different magnetic characteristics. Alternative means are a circuitry that can provide controlling ability and gradual applying of the electric power to the electromagnets, and so on can be used.

According to one embodiment of the invention, the spring is replaced by changing the direction of the electric power (e.g., by a relay), so that the magnetic objects push rather than pull each other.

Figure 6:
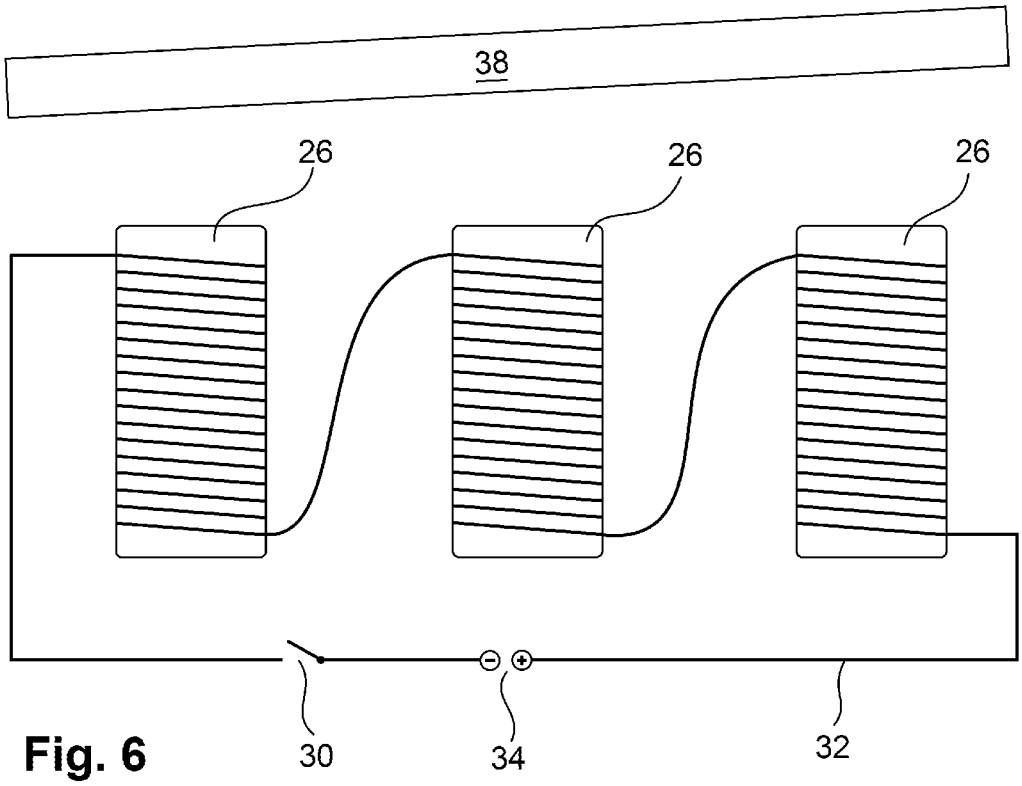
FIG. 6 schematically illustrates a circuit for use in a hair straightening apparatus, according to one embodiment of the invention.

FIG. 6 schematically illustrates a circuit for use in a hair straightening apparatus, according to one embodiment of the invention.

In the illustration there are three electromagnets 26 serially connected to each other by a cable 32. The circuit also comprises a switch 30 (which is turned on/off by pressing an appropriate button of the apparatus), and power source 34.

When the circuit is closed, the electromagnets pull the ferromagnetic plate 38.

The power of the left electromagnet (according to the figure's orientation) pulling the ferromagnetic plate 38 is greater than the corresponding power of the right electromagnet, since the ferromagnetic plate 38 is closer to the left electromagnet than the right electromagnet.

Figure 7A:
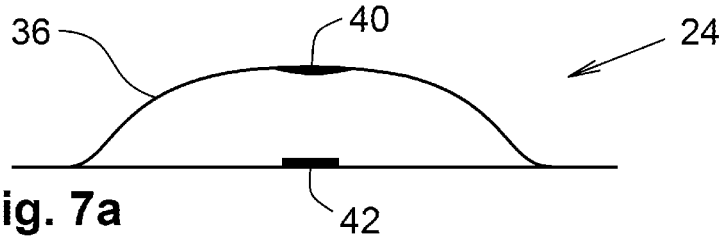
FIG. 7*a* is a sectional view illustrating an on/off button 24 in its "off" state, according to one embodiment of the invention.
Figure 7B:
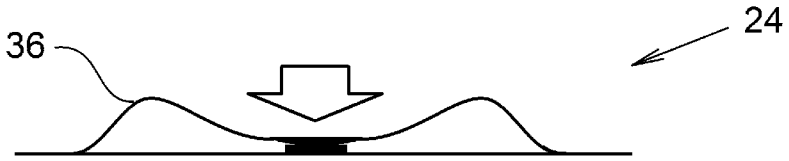
FIG. 7*b* illustrates the on/off button of FIG. 7 in its "on" state.

FIG. 7*a* is a sectional view illustrating an on/off button 24 in its "off" state, according to one embodiment of the invention. FIG. 7*b* illustrates the on/off button of FIG. 7 in its "on" state.

Button 24 comprises a flexible dome (for example made of rubber), wherein the center of its inner side comprise a contact 40. Opposite to contact 40 is disposed another contact 42.

When the dome is pressed as illustrated in FIG. 7*b*, the dome deforms and the contacts 40 and 42 touch each other, and as a result, a circuit that provides electric power to the electromagnets is close, thereby causing the jaws to approach each other. When releasing the pressure, the dome returns to its first state, the contacts draw away from each other, and the circuit opens, i.e., the pulling power of the electromagnets ceases, and they draw away from each other as a result of the spring power.

The design of the on/off button 24 is very important to the apparatus, as the hair dresser performs the operation of turning on and off this button many times.

Another example of button 24 (not illustrated) is a touch button, i.e., a user touches the button in order to activate the pulling power between the jaws, and releases the button in order to cease the pulling power.

Yet another example of the on/off button 24 (not illustrated as well) is a proximity switch.

Figure 8:
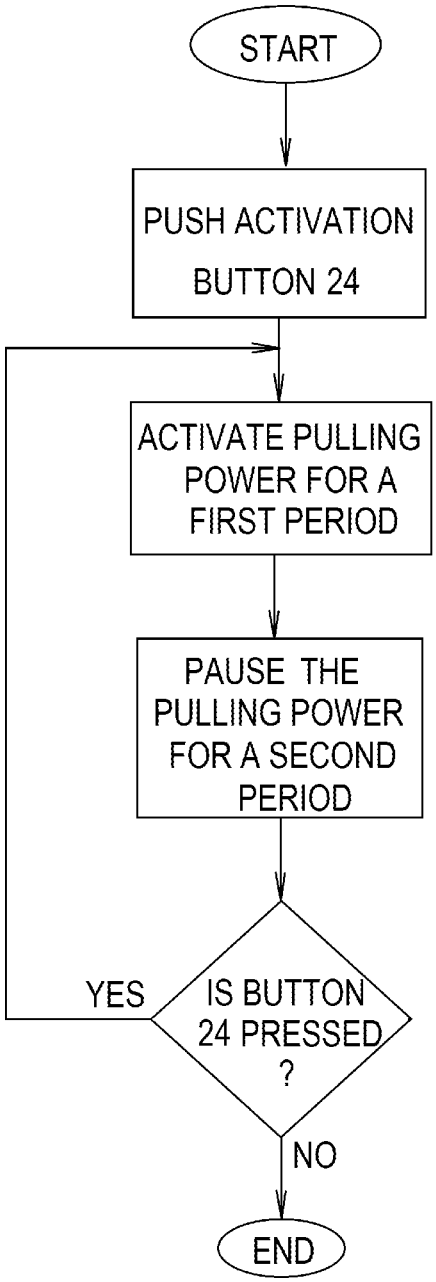
FIG. 8 is a flowchart schematically illustrating an operation of a button 24, according to a preferred embodiment of the invention.

FIG. 8 is a flowchart schematically illustrating an operation of a button 24, according to a preferred embodiment of the invention.

According to this embodiment of the invention, upon pressing the on/off button 24, the pulling power is applied for a first predefined period, and then the pulling power stops for a second predefined period. At this point, if the button is still pressed, the cycle is carried out again. Thus, the cycle is repeatedly performed as long as the user keeps pressing/touching/holding button 24. In this way, the user does not have to lift his thumb from button 24, until stopping the hair ironing operation.

In the figures and/or description herein, the following reference numerals (Reference Signs List) have been mentioned:

numeral 10 denotes a hair straightening apparatus;
numeral 12 denotes a "jaw";
numeral 14 denotes an axle;
numeral 16 denotes a ceramic plate;
numeral 18 denotes an operational button;
numeral 20 denotes an electric cable for connecting the apparatus to a power source;
numeral 22 denotes a user's thumb;
numeral 24 denotes an on/off button, for turning on/off the power for pulling the jaws to each other;
numeral 26 denotes an electromagnet;
numeral 28 denotes a slider;
numeral 30 denotes a switch;
numeral 32 denotes an electric cable;
numeral 34 denotes an electric power source;
numeral 36 denotes a flexible dome;
numeral 38 denotes a ferromagnetic plate; and
numeral 40 denotes contacts which close a circuit upon touching each other.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

The invention claimed is:

1. A hair straightening apparatus, comprising:
two jaws (12), pivotally connected by a hinge (14);
two ironing plates (16), each installed in a different jaw of said jaws, and a heating mechanism of said ironing plates;
said jaws having an open state in which said ironing plates are apart from each other, and a closed state in which said ironing plates are pulled to each other;
a first group of electromagnets (26) installed on one of said jaws, and a corresponding magnetic object installed in the other jaw, wherein said corresponding magnetic object is in a form of a ferromagnetic plate (38) or in a form of a second group of electromagnets, wherein electromagnets of said first group of electromagnets have different magnetic characteristics from each other and/or electromagnets of said second group of electromagnets have different magnetic characteristics from each other;
a controller, for changing an intensity of said power supply to electromagnets of said first group of electromagnets and/or electromagnets of said second group of electromagnets according to a program embedded therein, said controller adapted to repeatedly apply cycles of a first predetermined time period in which the jaws are in the closed state and a second predetermined time period in which the jaws are in an open state; and
an on/off button (24), for activating/deactivating electric power supply to said electromagnets of said first group of electromagnets, wherein said power supply switches said jaws from said open state to said closed state.

2. A hair straightening apparatus according to claim 1, further comprising a spring for retaining said jaws in said open state.

3. A hair straightening apparatus according to claim 1, further adapted to push said jaws away from each other in said open state.

4. A hair straightening apparatus according to claim 1, wherein said on/off button is in a form of an elastic dome having two contacts that touch each other when a user presses said dome.

5. A hair straightening apparatus according to claim 1, wherein said on/off button is in a form of a touch button.

6. A hair straightening apparatus according to claim 1, wherein said on/off button is in a form of a proximity switch.

7. A hair straightening apparatus according to claim 1, wherein said controller is adapted to soften an approaching process of said jaws to each other.

8. A hair straightening apparatus according to claim 1, wherein said controller is adapted to apply constant power while said jaws are in said closed state, wherein said constant intensity can be set.

9. A hair straightening apparatus according to claim 1, wherein said controller is adapted to apply cycles of:
a first period in which said jaws are in said close state; and
a second period in which said jaws are in an open state;
thereby allowing a user to iron a strand of hair without lifting his thumb from said on/off button (24).

10. A hair straightening apparatus according to claim 1, further comprising at least one input device for inputting at least first, second, and third values to said apparatus, said first value for setting a temperature of said heating, said second value for setting a pulling power of any electromagnets in said first group of electromagnets, and said third value for setting a pulling power of any electromagnets in said second group of electromagnets.

11. A hair straightening apparatus according to claim 1, wherein a pulling characteristic of electromagnets of said first group of electromagnets and/or electromagnets of said second group of electromagnets and/or a power supply thereto is set according to a distance of said electromagnets from said axle.

12. A hair straightening apparatus according to claim 10, wherein said input device is selected from a group consisting of: a slider, a knob.

* * * * *